US005460364A

United States Patent [19]

Ring

[11] Patent Number: 5,460,364

[45] Date of Patent: Oct. 24, 1995

[54] PORTABLE BALL BATTING PRACTICE APPARATUS

[76] Inventor: David L. Ring, 9955 Pibroch La., Wilton, Calif. 95693

[21] Appl. No.: 58,276

[22] Filed: May 4, 1993

[51] Int. Cl.[6] ..... A63B 69/00

[52] U.S. Cl. ..... 273/26 E; 273/29 A; 273/58 C; 273/413

[58] Field of Search ..... 273/26 E, 29 A, 273/26 EA, 26 R, 26 D, 29 R, 58 C, 413

[56] References Cited

U.S. PATENT DOCUMENTS

| | | | |
|---|---|---|---|
| 2,058,277 | 10/1936 | Walther | 273/26 E |
| 2,976,040 | 3/1961 | Bales | 273/26 E |
| 3,425,700 | 2/1969 | Edwards | 273/58 C |
| 3,626,502 | 12/1971 | Well . | |
| 3,652,088 | 3/1972 | Marsh | 273/26 E |
| 3,994,494 | 11/1976 | Kelley | 273/26 E |
| 4,451,036 | 5/1984 | Sinclair | 273/26 E |
| 4,647,042 | 3/1987 | Bruce . | |
| 4,815,735 | 3/1989 | McClenny . | |
| 4,872,675 | 10/1989 | Crowden . | |
| 4,964,634 | 10/1990 | Boyer . | |
| 5,000,450 | 3/1991 | Beintema | 273/26 E |
| 5,056,781 | 10/1991 | Preston | 273/26 E |
| 5,271,618 | 12/1993 | Malwitz | 273/26 E |
| 7,331,926 | 5/1973 | Vincent | 273/26 E |

*Primary Examiner*—Theatrice Brown
*Attorney, Agent, or Firm*—James M. Ritchey

[57] ABSTRACT

A portable ball batting apparatus for attachment to a preexisting support comprises an elongated member having two ends. The elongated member is attached to one end of a resilient tether, while the other end of the resilient tether is secured to a ball. Incorporated into the elongated member is a releasable anchoring system for attaching the elongated member to the support.

4 Claims, 5 Drawing Sheets

PORTABLE BALL BATTING PRACTICE APPARATUS

BACKGROUND OF THE INVENTION

1. Field of the Invention

A training apparatus for assisting a user in developing ball batting skills is provided. More particularly, the apparatus releasable secures to an existing support and includes an arm member having a resiliently tethered ball.

2. Description of the Background Art

Several related devices have been found in the prior art that comprise ball hitting trainers. However, these devices are rather complex structurally and incorporate self supporting elements.

In particular, disclosed in U.S. Pat. No. 3,626,502 is a tethered ball for baseball batting practice. Comprising the device is a stake having an internal spring that is fastened to one end of a tether. A ball is fastened to the other end of the tether.

Related in U.S. Pat. No. 4,815,735 is a pitching machine having a tethered ball that is secured to a horizontal arm that is part rigid and part semi-rigid. The arm is attached to a vertical support member. A motion damping mechanism is included.

A sports training device is presented in U.S. Pat. No. 4,847,042. A weighted base member extends into an adjustable vertical support. Attached to the top of the vertical support is a horizontal arm that terminates in a tether that is secured to a ball.

U.S. Pat. No. 4,872,675 describes a baseball pitching device having a base support and a rotating arm attached to the base. The arm has a tethered ball anchored to one end and a counter weight at the other end. Means are supplied for rotating the arm relative to the base support to produce a moving ball to strike.

Disclosed in U.S. Pat. No. 4,872,675 is a tethered ball batting practice device comprising a ball secured to a two-part tether having a cord section and a resilient section. The end of the resilient section is mated to a stake that has a backup anchor.

SUMMARY OF THE INVENTION

An object of the present invention is to provide an inexpensive and easy to set up ball batting practice apparatus.

Another object of the present invention is to disclose a ball batting practice apparatus that is fast to set up and take down.

A further object of the present invention is to relate a ball batting practice apparatus small, lightweight, and easily transported.

Still another object of the present invention is to make known a ball batting practice apparatus that provides a moving target to hit.

Yet a further object of the present invention is to supply a ball batting practice apparatus that utilizes the force the batter exerts to energize the apparatus for the next pitch and therefore requires no electricity to deliver a pitch-like target ball to a hitter.

Yet another object of the present invention is to provide a ball batting practice apparatus that has interchangeable resilient tethers to permit weak and strong hitters to utilize the same basic device for practice.

Still yet another object of the present invention is to disclose a ball batting practice apparatus that is easily supported by preexisting supports that are found at standard ball practice areas.

Still a further object of the subject invention is to make it easy for one person to operate and obtain many pitches in a short amount of time without the necessity of a new setup before each pitch.

Disclosed is a portable ball batting apparatus for attachment to a pre-existing support. The subject apparatus comprises an essentially hollow elongated member having first and second ends and an interior space. A support contacting plate is attached to the elongated member second end as is a support anchoring strap. A resilient tether having first and second ends is attached by the tether's first end to the elongated member by releasable means and a ball is secured to the tether's second end. Provided are means for anchoring the elongated member second end to the support, wherein the support is releasable secured between the support contacting plate and the anchoring strap. Further, the support contacting plate usually has a resilient surface coating that contacts the support for added frictional interaction and minimizes possible damage to the pre-existing support's.

A plurality of embodiments of the anchoring means are related. First, a threaded rod having first and second ends and runs through the elongated member's interior space. A handle is attached to the rod first end, wherein the handle protrudes out past the elongated member first end. Alternative means are provided for applying pressure against the support in slightly different manners and are associated with the threaded rod second end. When the handle is rotated in a first direction the threaded rod's rotation tightens the anchoring strap around the support and when the handle is rotated in a second direction the threaded rod's rotation loosens the anchoring strap around the support. The anchoring strap is mounted to the device in two different fashions.

Another anchoring means embodiment provides a lever pivotally secured to the elongated member and pivots between a first position against the elongated member and a second position away from the elongated member. A cam locking linkage inside the elongated member's interior space is attached to the lever. Means are included for applying pressure against the support, whereby when the lever is forced into the first position against the elongated member the cam locking linkage tightens the anchoring strap around the support and when the lever is released into the second position away from the elongated member the cam locking linkage loosens the anchoring strap around the support.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–6, there are shown preferred embodiments of a portable ball batting apparatus 5 (*a, b,* and *c*) that attaches to a support S. Usually, the support S is a vertical or horizontal fence post or similar structure that is found in a preexisting form at a ball practice location and is not built or installed for each practice session with the subject invention. Most ball practice areas have vertical fence posts that are ideal attachment sites for the subject apparatus. Since vertical fence posts are often about three feet to about six feet in height or greater, the subject device can be anchored at any desired height for a user.

Figure 1:
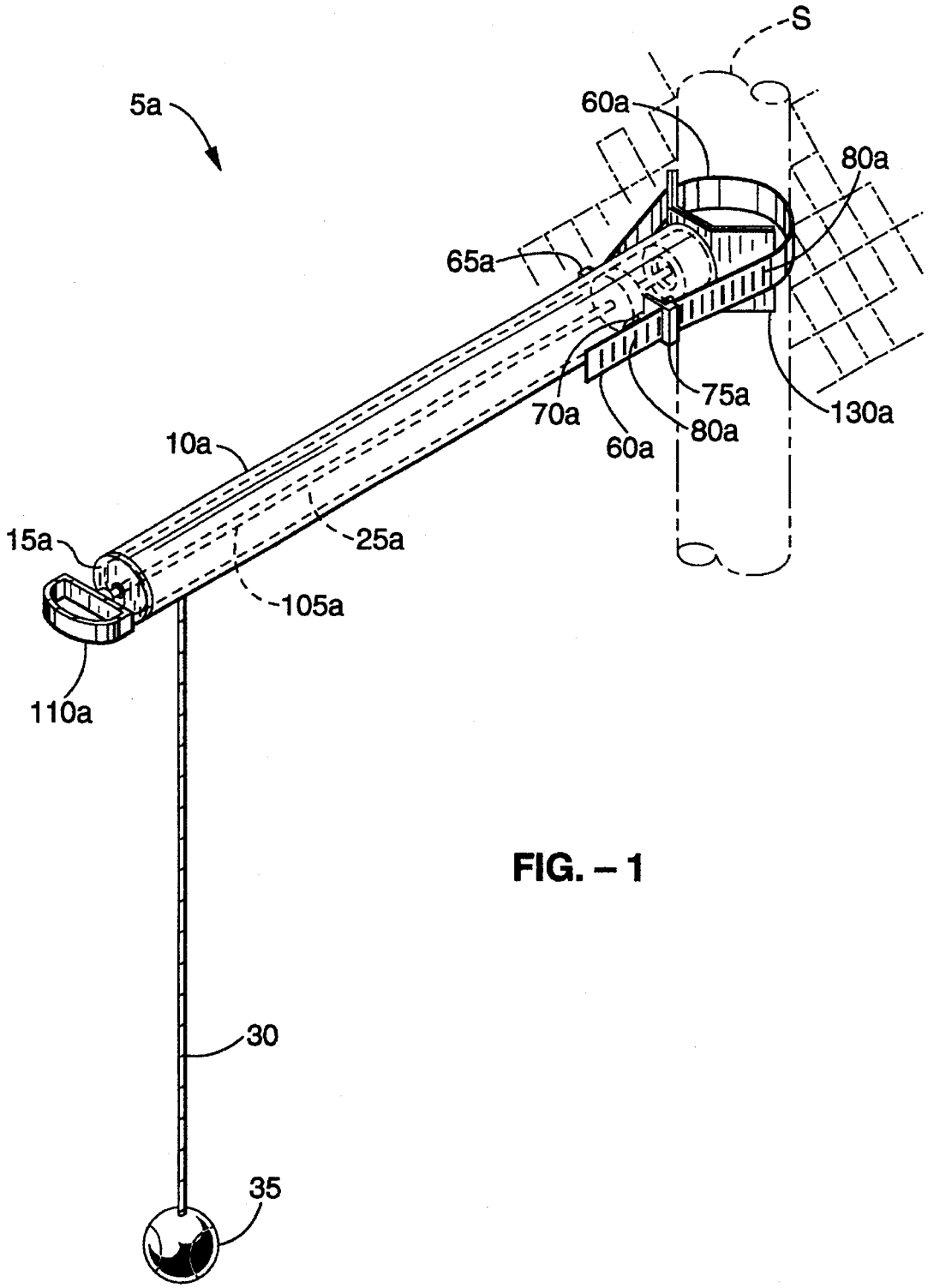
FIG. 1 is a perspective view of a first embodiment of the subject invention showing attachment to a pre-existing vertical support.
Figure 2:
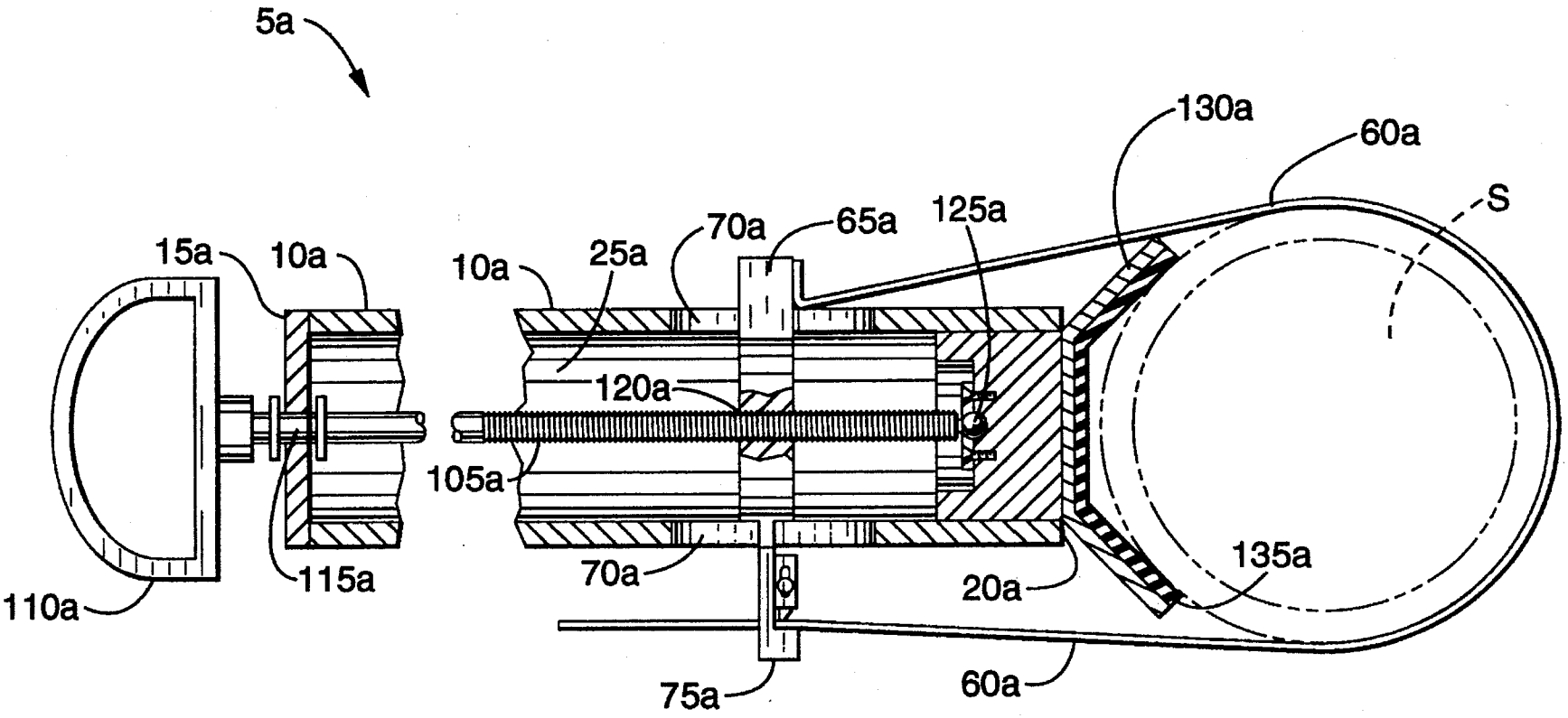
FIG. 2 is a cross sectional view of the first embodiment of the subject invention showing a screw activated locking system with a moving strap.
Figure 5:
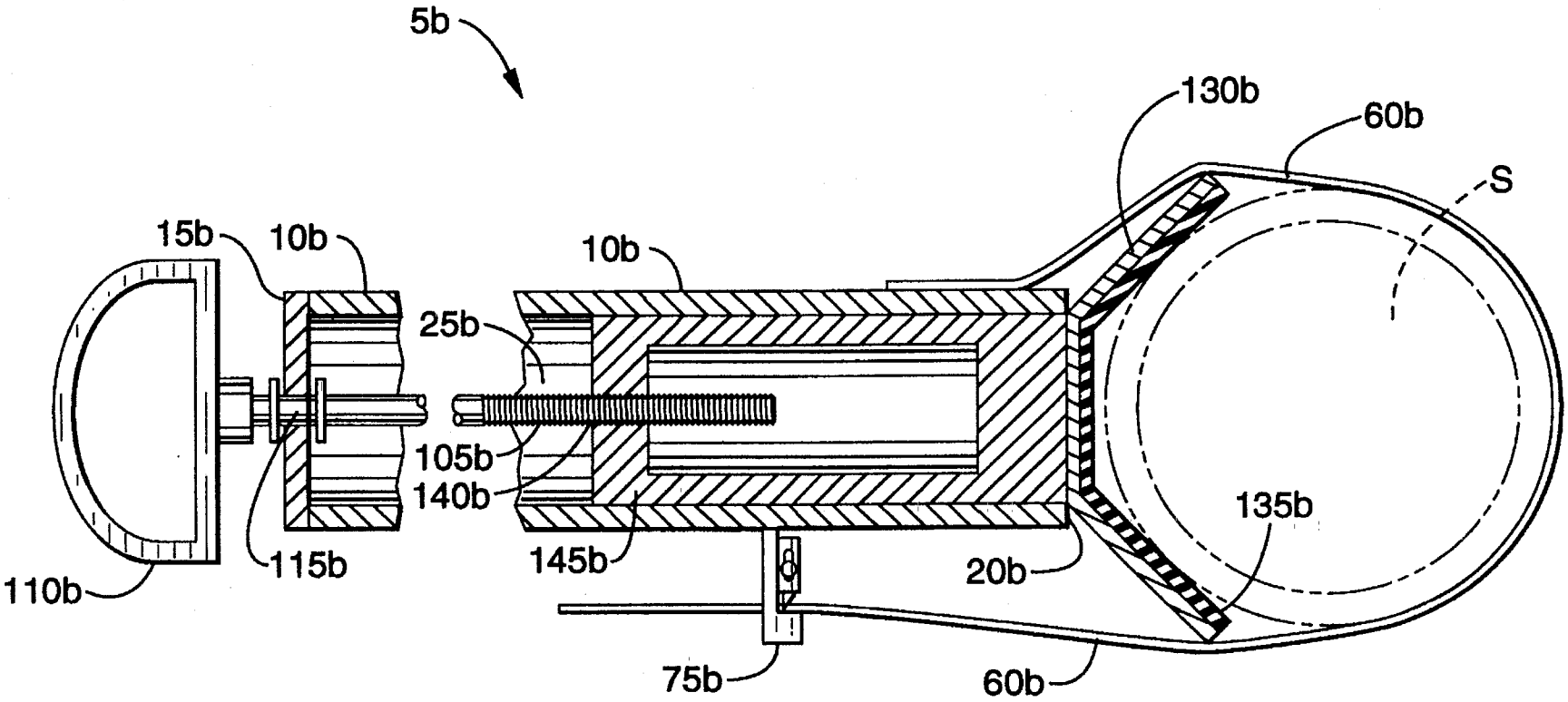
FIG. 5 is a cross sectional view of a second embodiment of the subject invention showing a screw activated locking system with a fixed strap.
Figure 6:
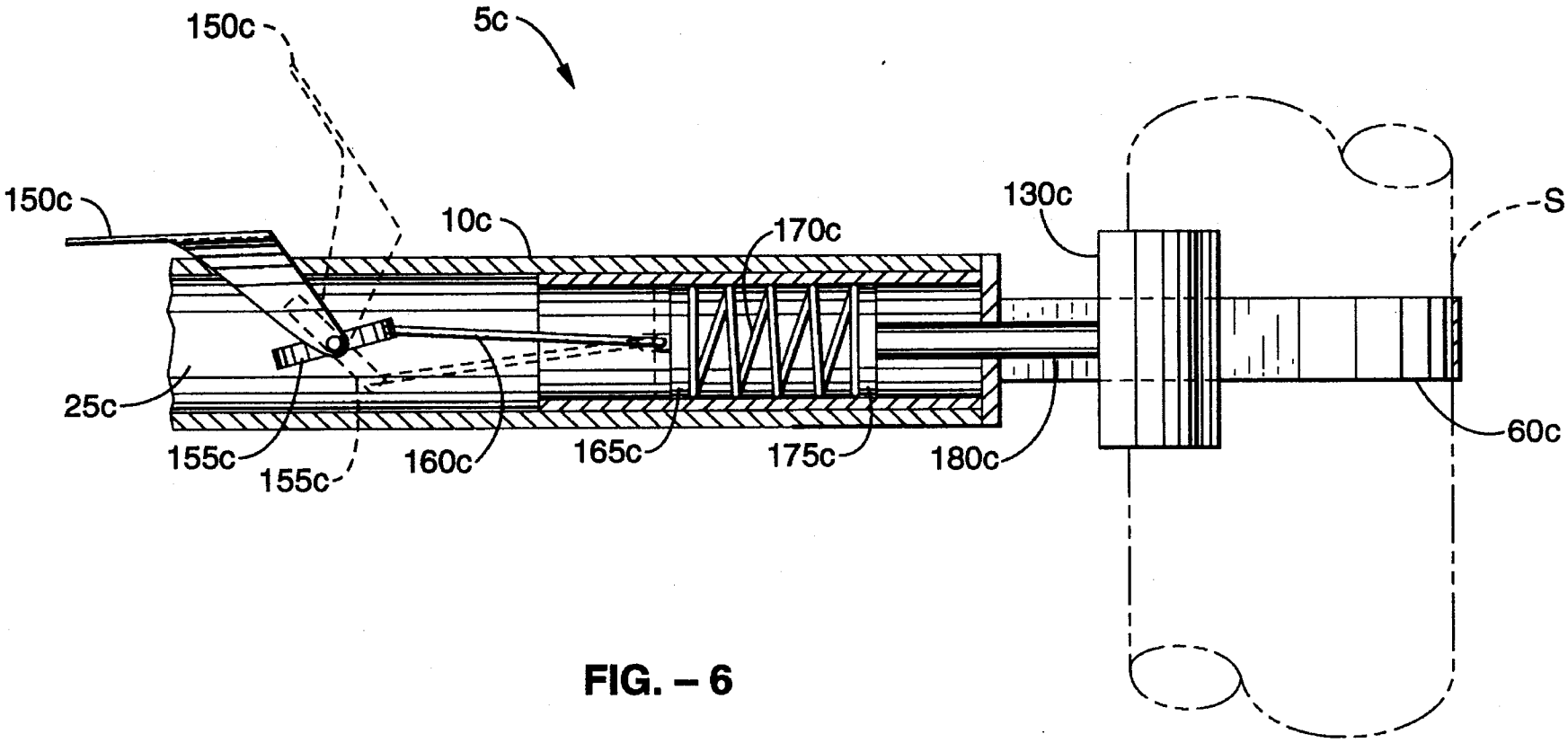
FIG. 6 is a cross sectional view of a third embodiment of the subject invention showing a lever activated cam locking system in closed and open positions.

It is noted that in this disclosure the number associated letters "a", "b", and "c" represent equivalent embodiments or elements of the subject invention. If only a number is related, without an associated a, b, or c letter, that portion of the subject device is generic. The three depicted embodiments (5*a*, 5*b*, and 5*c*) are discussed separately, however, it must be appreciated that the subject invention is related with alternative means, including the three embodiments presented in detail. FIGS. 1 and 2 relate the first embodiment, FIG. 5 depicts the second embodiment, and FIG. 6 shows the third embodiment.

As illustrated in FIGS. 1 and 2, comprising a first embodiment of the subject apparatus 5*a* is an essentially hollow elongated member 10*a* that serves as a central framework structural element for the subject apparatus 5*a*. Normally, the elongated member 10*a* is fabricated from materials such as metal or polymeric substances and is formed in a cylindrical structure. Other equivalent geometric configurations equivalent to a cylinder are contemplated to be within the realm of this disclosure. Usually, the elongated member 10*a* is rigid or semi-rigid, The elongated member 10*a* has first 15*a* and second 20*a* ends and an interior space 25*a*.

Figure 3:
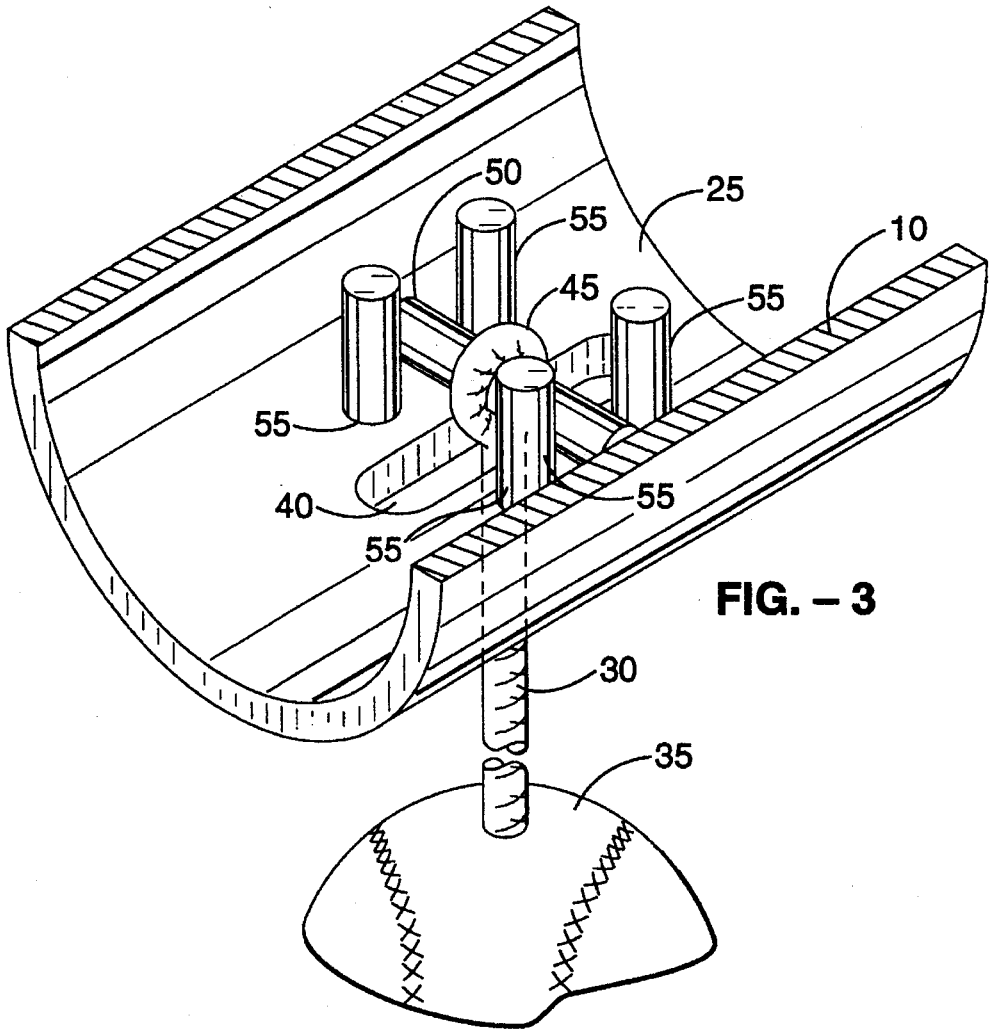
FIG. 3 is a cross sectional view of the subject invention showing a tether attachment means.
Figure 4:
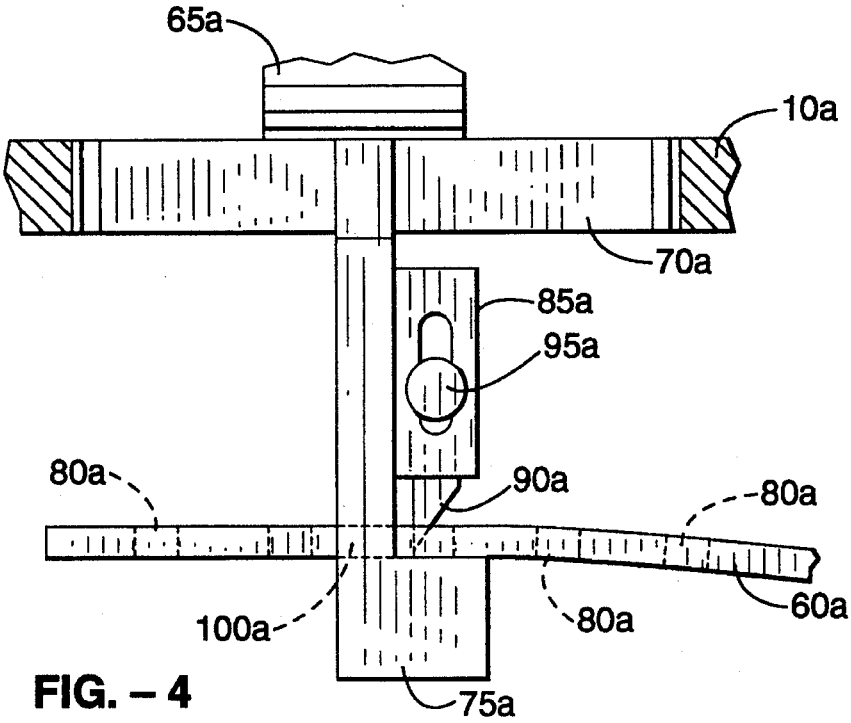
FIG. 4 is a cross sectional view of the strap securing lock.

As seen in FIG. 1, a tether 30 is secured at one end to the elongated member 10*a* and by its other end to a ball 35. FIG. 3 illustrates one possible attachment means for the elongated member 10 of all three embodiments of the subject invention. A slot 40 is formed in the elongated member 10 which enters the interior space 25. An anchor rod 50 is secured by standard means to a loop 45 at one end of the tether 30. The tether 30 is fastened to the elongated member 10 by inserting the tether associated anchor rod 50 within the slot 40 and wedging it over and between anchoring pins 55. The anchoring pins 55 are connected to the inside of the elongated member 10 proximate the slot 40. Such a tether anchoring means provides a quick method of securing the tether 30 to the elongated member 10. If the tether 30 should break or a different tether be required, little effort is required to remove and insert a new tether.

Preferably, the tether 30 is constructed from resilient materials. The resilient tether 30 provides a means for storing the energy of the batted ball when it wraps around the elongated member 10 after the ball is batted. The centrifugal force, due to the rotational velocity of the batted ball, creates tension in the tether causing it to stretch. After wrapping around the elongated member 10 in a slightly extended form, the stored energy causes the tether 30 to unwrap in a manner that swings the ball 35 into a moving target for the batter. Further, should the user desire a more or less resilient tether 30, the tether 30 is easily replaced with a new tether 30 having a different resilience. For example, a strong hitter might desire a tether 30 with a low degree of elasticity or resilience because a hard hit ball will have a higher centrifugal force, thus requiring less elasticity to store the energy for the return pitch, whereas a weak hitter or younger player might need a tether 30 with a high degree of elasticity or resilience to store easily the decreased amount of bat imparted energy in the wrapped tether 30. Regardless of the exact elasticity or resilience of the tether 30 the associated ball 35 rotates back to an unwrapped position with enough velocity to provide a pitch-like environment to the batter.

Fastened to the other end of the tether 30 is the ball 35. Standard means are envisioned to secure the ball 35 to the tether 30. The ball 35 is resilient and of conventional forms and sizes. Either permanent or replaceable ball securement means are contemplated. Such securement means comprise the tether 30 being integral with the ball 35 or associated in an appropriate manner to provide secure attachment during the delivered force of the batting process.

Means for anchoring the elongated member 10*a* to the support S are provided. This is the portion of the subject invention that varies from one embodiment to another (5*a*, 5*b*, and 5*c*). FIG. 2 shows a cross section of one anchoring means that describes means for tightening an anchoring strap. 60*a* about the support S. The anchoring strap 60*a* that fits around the support S is attached to a sliding member 65*a* that fits and moves within opposing channels 70*a* formed in the elongated member 10*a*. The strap 60*a* is usually a flattened and flexible strip of metal or polymeric material and has two ends. One of the strap 60*a* ends is permanently attached by standard and appropriate means to the sliding member 65*a* while the other strap 60*a* end fits within a releasable locking means 75*a*. The locking means 75*a* is attached to the sliding member 65*a*. In the end of the strap 60*a* that fits within the releasable locking means are a series of apertures or notches 80*a*. The locking means comprises a housing 85*a* having a one-way locking pin 90*a* with an angled surface. Protruding from the housing 85*a* is a release knob 95*a*. Within the housing 85*a* is resilient means that Torre the pin into locking position. Once the strap 60*a* is fitted or wrapped around a selected support S the gross securement is accomplished by inserting the free strap 60*a* end into a receiving aperture 100*a* in the looking means 75*a*. As the strap 60*a* slides into the receiving aperture 100*a* the pin 90*a* travels into and out of the series of notches 80*a* in the strap 60*a*. When the strap 60*a* is hand-tight the pin 90*a* fits within an appropriate notch 80*a*. Variations of the strap attachment means are contemplated and may include omitting the described locking means and substituting an equivalent hooking mechanism that directly fits a portion of the sliding member 65*a* into the strap notches 80*a*.

To achieve a well secured connection to the support S a final tightening, in addition to the above described gross securement, is needed. FIG. 2 depicts a screw activated locking system that achieves the final tightening. A threaded rod 105*a*, having first and second ends, runs through the elongated member's interior space 25*a*. A handle 110*a* is attached to the threaded rod's 105*a* first end. The handle 110*a* protrudes out past the elongated member's first end 15*a* and is fitted in the first end 15*a* by rotational means 115*a* (bearings or the like) that permit free rotation of the threaded rod 105*a* within the elongated member 10*a*.

Associated with the second end of the threaded rod 105*a* is a pressure applying means that produces the final tightening action, whereby when the handle i 10*a* is rotated in a first direction the threaded rod's 105*a* rotation tightens the anchoring strap 60*a* around the support S and when the handle 110*a* is rotated in a second direction the threaded rod's 105*a* rotation loosens the anchoring strap 60*a* around the support S. The threaded rod 105*a* is screwed through a threaded aperture 120*a* in the sliding member 65*a* and secured by its second end in an appropriated rotational anchoring means 125*a* affixed in the elongated member's second end 20*a*. The appropriate rotation anchoring means 125*a* is a ball joint and receiving fixture or equivalent means fastened proximate the elongated member's second end 20*a*. Alternate embodiments may include versions that omit the anchoring means 125*a* and rely on the elongated member's fist end rotation means 115*a* to supply the necessary anchoring point and equivalent variations.

Attached to the outside of the elongated member's 10*a* second end 20*a* is a support contacting plate 130*a*. FIG. 2 illustrates a typical cross section of the plate 130*a*. The plate 130*a* is usually rigid and is preferably coated with a resilient surface 135*a* that contacts the support S and provides additional frictional interaction between the support S and plate 130*a*. Also, the resilient surface 135*a* minimizes or eliminates scarring damage to the support's surface. The resilient surface coating 135*a* is a polymeric substance like rubber or plastic or similar material.

Clearly, after the strap 60*a* is wrapped around the support S and releasable secured within the locking means 75*a*, then when the handle 110*a* (shown in FIGS. 1 and 2) is rotated in an appropriate direction the plate 130*a* forces the support against the strap 60*a* and tightens the subject device to the support S. To release the strap the handle 110*a* is rotated in the reverse direction employed for tightening and the knob 95*a* is slid to release pin 90*a* from the strap 60*a*.

A second embodiment of the subject invention is depicted in FIG. 5. The FIG. 5 device is very similar to the embodiment shown in FIGS. 1 and 2. However, with this embodiment the sliding member 65*a* is replaced with a piston-like mechanism. A threaded rod 105*b* runs within the elongated member's 10*b* interior space 25*b* and through a receiving aperture 140*b* in a slidable piston block 145*b*. As the threaded rod 105*b* is rotated in an appropriate direction the piston block 145*b* moves within the elongated member's 10*b* interior space 25*b*. A support contacting plate 130*b* is connected to the piston block 145*b*. The locking means 75*b* is directly attached to the outside of the elongated member 10*b*. The strap 60*b* is permanently anchored at one end to the outside of the elongated member 10*b* while the other end of the strap 60*b* runs through the locking means 75*b*. Support gripping pressure is exerted by the plate 130*b* on the support S by rotating, in an appropriate direction, the threaded rod 105*b*. As the rod 105*b* rotates, the piston block 145*b* slides within the interior space 25*b*.

A third embodiment of the subject invention is illustrated in FIG. 6. A lever activated cam locking system is disclosed having a lever 150*c* that is pivotally secured to the elongated member 10*c*. During the locking process the lever 150*c* pivots between a first or locked position against the elongated member (shown with solid lines in FIG. 6) and a second or released position away from the elongated member 10*c* (depicted with dashed lines in FIG. 6). A cam locking-linkage within the elongated member's interior space 25*c* is attached to the lever 150*c*. Comprising the cam locking linkage is a pivoting plate 155*c* attached to an arm member 160*c* which is turn attached to a first sliding plate 165*c*. A resilient means 170*c* is located between the first sliding plate 165*c* and a second sliding plate 175*c*. The second sliding plate 175*c* extends into or is connected to a pressure exerting arm rod 180*c* that fastens to the support contacting plate 130*c*.

As FIG. 6 portrays, when the lever 150*c* is in the open or released position (dashed lines) the support contacting plate 130*c* is released. The strap 60*c* is anchored permanently by one of its ends to the outside of the elongated member 10*c* and the other end, with the notches, fits within the locking means (not shown in FIG. 6). The strap 60*c* is grossly adjusted or tightened loosely as in the above two embodiment description. The final tightening is accomplished by pushing the lever 150*c* down into the locked position (solid lines). The pivoting plate 155*c* pivots and forces the arm member 160*c* forward thereby advancing the first sliding plate 165*c* towards the elongated member's 10*c* second end. the resilient means 170*c* responds to the first sliding plate's 165*c* movement and exerts pressure on the second sliding plate 175*c*. The force is transferred via the pressure arm 180*c* to the support contacting plate 130*c* and the strap 60*c* is forced around the support S. To release the subject device 5*c* the lever 150*c* is moved into the second position away from the elongated member 10*c*, thereby removing the tension with the cam locking linkage.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A portable ball batting practice apparatus for attachment horizontally to a preexisting support, comprising;

a hollow elongated member having first and second ends;

a resilient tether having first and second ends; non-rotational means attaching said tether first end adjacent said first end of said elongated of said elongated member;

a ball secured to said tether second end;

said tether having a resiliency such that when said ball is struck by a batter said tether will be wrapped around said elongated member and thereby store energy therein, said stored energy will cause said tether to be unwound about said elongated member in a manner that swings said ball as a moving target;

means for anchoring said elongated member to a preexisting support, said means for anchoring being an anchor strap attached to said elongated member second end;

means for tightening said strap about the support;

said means for tightening being a threaded rod having first and second ends, said rod extending longitudinally through said hollow elongated member;

a handle attached to said rod first end and protruding past said elongated member first end; said means for tightening further include means in said elongated member threadably engaged with said threaded rod second end and attached to said anchor strap, whereby when said handle is rotated in a first direction said anchor strap is tightened around said support and when said handle is rotated in a second opposite direction said anchor strap is loosened from around the support.

2. A portable ball batting practice apparatus as define in claim 1 wherein;

said means for tightening said strap further includes, a lever pivotally attached to said elongated member by a pivot shaft extending diametrically through said elongated member and pivots between a first position against an outer surface of said elongated member and a second position away from said elongated member;

a pivot plate disposed within said hollow of said elongated member and rigidly attached to said pivot shaft; means connecting said pivot plate to said anchor strap such that when said lever is forced into said first position said anchor strap is tightened around the support and when said lever is moved to said second position away from said elongated member said anchor strap is loosened from around the support.

3. The portable ball batting practice apparatus as defined in claim 1, wherein;

said means for tightening said strap further includes a slide member position adjacent said second end and interior of said hollow elongated member, said slide member having opposite portions thereof extending through diametrically opposed longitudinally extending slots in said elongated member; said threaded rod extending through a threaded aperture in said slide member and having its second end rotatably anchored in a stationary member attached to said elongated member second end;

said anchor strap having one of its ends permanently attached to one of said opposite portion of said slide member and the other of its ends adjustably attached the other of said opposite portions of said slide member, whereby when said handle is rotated in first direction said slide member will move longitudinally in said elongated member to tighten said anchor strap about the support and when said handle is rotated in a second direction said anchor strap is loosened around the support.

4. A portable ball batting practice apparatus as defined in claims 1 or 2 or 3 further comprising, a support contacting plate attached to said elongated member second end, said plate having friction increasing means for contacting a support, the support being releasably secured between said friction increasing means on said plate and said anchoring strap.

* * * * *